US010322355B1

(12) United States Patent
Liu et al.

(10) Patent No.: US 10,322,355 B1
(45) Date of Patent: Jun. 18, 2019

(54) PORTABLE TOY GUN CAPABLE OF BEING QUICKLY ASSEMBLED AND DISMANTLED

(71) Applicants: G & P INDUSTRIAL CO. LIMITED, KL (HK); Evike.com, Inc., Alhambra, CA (US)

(72) Inventors: Yi Chun Liu, KL (HK); Evike Chang, Alhambra, CA (US)

( * ) Notice: Subject to any disclaimer, the term of this patent is extended or adjusted under 35 U.S.C. 154(b) by 0 days.

(21) Appl. No.: 15/952,256

(22) Filed: Apr. 13, 2018

(30) Foreign Application Priority Data

Feb. 12, 2018 (CN) ..... 2018 2 0248937 U

(51) Int. Cl.
*A63H 5/04* (2006.01)
*A63H 33/30* (2006.01)
*F41B 7/08* (2006.01)

(52) U.S. Cl.
CPC ..... *A63H 33/30* (2013.01); *A63H 5/04* (2013.01)

(58) Field of Classification Search
CPC ..... A63H 5/04; A63H 13/10; A63H 33/009; F41B 7/08; F41A 19/10
USPC ..... 446/473; 42/54, 57; 124/83–85
See application file for complete search history.

(56) References Cited

U.S. PATENT DOCUMENTS 1,421,334 A * 6/1922 Williams ..... F41C 3/06 102/702
2,051,564 A * 8/1936 Marra ..... F41B 7/003 124/37
3,266,183 A * 8/1966 Tada ..... F41C 3/08 42/57
8,800,541 B2 * 8/2014 Hu ..... F41A 33/06 124/32
2014/0238373 A1 * 8/2014 Yang ..... F41B 11/80 124/83

FOREIGN PATENT DOCUMENTS

CN 201521136259.5 * 12/2015 ..... A63H 5/04

* cited by examiner

*Primary Examiner* — Kien T Nguyen
(74) *Attorney, Agent, or Firm* — Prakash Nama; Global IP Services, PLLC

(57) ABSTRACT

A portable toy gun capable of being quickly assembled and dismantled, including a first gun barrel and a second gun barrel, a gun stock mounted at one end of the first gun barrel, a trigger component connected to one side of the first gun barrel, and a handle and a magazine mounted at two opposite ends of the trigger component respectively. The first gun barrel includes an outer sleeve, a first bore, and a locking mechanism mounted on the outer side of one end of the outer sleeve. A plug is mounted at one end of the first bore, and a guiding locating protrusion is disposed on one side of the plug. The second gun barrel includes a second outer sleeve and a second bore. One end of the second outer sleeve defines a locking hole corresponding to the locking mechanism and a slot corresponding to the plug.

7 Claims, 4 Drawing Sheets

PORTABLE TOY GUN CAPABLE OF BEING QUICKLY ASSEMBLED AND DISMANTLED

BACKGROUND OF THE INVENTION

The utility model relates to a toy gun, and in particular to a portable wargame toy gun capable of being quickly assembled and dismantled.

Toy guns are essential equipment for wargame lovers. No matter an individual or an enterprise participates in a wargame, toy guns can help the participants get full exercises and self-expressions. However, since the gun barrel of the toy gun is relatively long, the toy gun is inconvenient to carry outdoors and store indoors. Therefore, toy guns capable of being dismantled are particularly useful, especially ones having gun barrels capable of being dismantled. The length of such toy guns can be half reduced, which is beneficial for outdoor carrying and indoor storage.

Chinese utility model with application number 201521136259.5 discloses a Splicing-Type Toy Gun, which mainly includes a connection structure. The gun defines a slot on one end thereof. The slot has a magnetic element provided therein. Spliced components, such as gun-sight, submachine gun barrel, magazine, gunstock, telescope and footstand, is provided with a plug on one end thereof corresponding to the slot. The plug has a metal piece provided thereon. When splicing the toy gun, it is only needed to make the plug of the gun aligned to and inserted into the slot, then the plug and the slot can automatically attract each other and are in firm connection under the action of the magnetic force. Meanwhile, when dismantling the toy gun, it is only needed to apply an external load greater than the magnetic force to separate the toy gun from the spliced components.

However, when splicing the toy gun, the metal piece of the plug needs to be aligned to the magnetic element in the slot before magnetic attraction. This is relatively troublesome for users. The magnetic attraction mode is capable of being dismantled. When an external stress is greater than the magnetic force, the gun and the spliced components are easy to separate from each other. The solution to this problem is to increase the magnetic force. However, increasing the magnetic force will cause difficulty in dismantling, and an external load greater than the magnetic force is needed to detach the gun from the spliced components; therefore, it is relatively difficult for users to operate.

BRIEF SUMMARY OF THE INVENTION

In order to overcome the above drawbacks in existing technologies, the utility model provides a portable toy gun capable of being quickly assembled and dismantled, of which a gun barrel part can be dismantled quickly into two sections and meanwhile can be assembled quickly, and of which the two gun barrels have a strong enough binding force there-between and are not easy to fall off.

To achieve the above aim, the utility model provides a portable toy gun capable of being quickly assembled and dismantled. The toy gun includes a gun barrel. The gun barrel includes a first gun barrel, and a second gun barrel detachably connected with the first gun barrel. A gun stock is mounted at one end of the first gun barrel. A trigger component is connected to one side of the first gun barrel. A handle is mounted at one end of the trigger component, and a magazine is mounted at the other end of the trigger component. The first gun barrel includes a first gun barrel outer sleeve, a first bore mounted in the first gun barrel outer sleeve, and a locking mechanism mounted on the outer side of one end of the first gun barrel outer sleeve. A plug is mounted at one end of the first bore. A guiding locating protrusion is disposed on one side of the plug. The second gun barrel includes a second gun barrel outer sleeve, and a second bore mounted in the second gun barrel outer sleeve. One end of the second gun barrel outer sleeve defines a locking hole corresponding to the locking mechanism, and a slot corresponding to the plug. The locking mechanism is in detachable connection with the locking hole, thereby realizing the detachable connection between the first gun barrel and the second gun barrel. The slot has an inner wall defining a locating groove corresponding to the guiding locating protrusion. During installation, the guiding locating protrusion is inserted into the locating groove, so that the plug is in fixed connection with the slot.

As a preferred embodiment, the second gun barrel outer sleeve has one side corresponding to the locating groove mounted with a locating base. Through the locating base, the locating groove can be aligned to the guiding locating protrusion quickly.

As a preferred embodiment, the locking mechanism includes a locating sleeve, and a locating core mounted in the locating sleeve. The locating core moves in the locating sleeve to facilitate the assembly and the disassembly between the first gun barrel and the second gun barrel.

As a preferred embodiment, the locating sleeve has one side defining a first limiting hole and the other side defining a second limiting hole, the locating sleeve defines therein a slide groove and a locating slide groove in communication with the slide groove, the locating core includes a limiting rod passing through the first limiting hole and the second limiting hole, and the limiting rod is in fixed connection with a locating rod corresponding to the locking hole. The limiting rod can be toggled so that the locating rod is clamped into the locking hole to realize the fixed connection between the first gun barrel and the second gun barrel, after the locking hole on the second gun barrel is aligned to the locating rod. The locating rod has one end connected with a sliding rod. The sliding rod has a spring sleeved thereon. The spring presses against the locating rod so that the locating rod will not slide out from the locking hole. The locating rod is in sliding connection with the locating sleeve in the slide groove. One end of the sliding rod in connection with the locating rod is in sliding connection with the locating sleeve in the slide groove, and the other end of the sliding rod is in sliding connection with the locating sleeve in the locating slide groove.

As a preferred embodiment, the spring has a width greater than that of the locating slide groove and less than that of the locating rod, so that the locating slide groove clamps the spring and that the spring applies a pressure to the locating rod to make one end of the locating rod clamped in the locking hole and difficult to slide out.

As a preferred embodiment, the width of the locating rod is less than that of the locking hole, so that the locating rod can be inserted into the locking hole to realize the connection between the first gun barrel and the second gun barrel.

As a preferred embodiment, one end of the locating rod inserted into the locking hole is provided as a circular arc shape, facilitating the locating rod to be inserted into the locking hole.

As a preferred embodiment, the guiding locating protrusion has a width less than that of the locating groove, so that the guiding locating protrusion can be inserted into the locating groove.

As a preferred embodiment, the first gun barrel outer sleeve and the second gun barrel outer sleeve have a clamping groove defined on one side thereof. The clamping groove is configured for quickly mounting a gun-sight. The gun-sight can be mounted at different positions on the gun barrel as actually needed.

Compared with the existing technology, the utility model has the following beneficial effects.

The portable toy gun includes a gun barrel. A gun stock is mounted at one end of the gun barrel. A trigger component is connected to one side of the gun barrel. A handle is mounted at one end of the trigger component, and a magazine is mounted at the other end of the trigger component. The gun barrel includes a first gun barrel, and a second gun barrel detachably connected with the first gun barrel. The first gun barrel includes a first gun barrel outer sleeve, a first bore mounted in the first gun barrel outer sleeve, and a locking mechanism mounted on the outer side of one end of the first gun barrel outer sleeve. A plug is mounted at one end of the first bore. A guiding locating protrusion is disposed on one side of the plug. The second gun barrel includes a second gun barrel outer sleeve, and a second bore mounted in the second gun barrel outer sleeve. One end of the second gun barrel outer sleeve defines a locking hole corresponding to the locking mechanism, and a slot corresponding to the plug. The locking mechanism and the locking hole can be assembled and disassembled quickly, thus the quick assembly and disassembly between the first gun barrel and the second gun barrel can be realized. The second gun barrel outer sleeve has one side corresponding to the locating groove mounted with a locating base. Through the locating base, the locating groove can be aligned to the guiding locating protrusion quickly.

BRIEF DESCRIPTION OF THE DRAWINGS

To better describe the technical scheme in the embodiment of the present invention or in related art, accompanying drawings needed in the description of the embodiment or related art are simply illustrated below. Obviously, accompanying drawings described hereinafter merely illustrate some embodiments of the utility model. For the ordinary skill in the field, other accompanying drawings may be obtained according to these accompanying drawings without creative work.

DETAILED DESCRIPTION OF THE INVENTION

The purpose, the technical scheme and the advantages of the embodiments of the utility model will become more clearly understood from the clear and complete description of the technical scheme of the embodiments of the utility model below taken in conjunction with accompanying drawings in the embodiments of utility model. Obviously, the embodiments described hereinafter are simply part embodiments of the utility model, but all the embodiments. All other embodiments obtained by the ordinary skill in the art based on the embodiments in the utility model without creative work are intended to be included in the scope of protection of the utility model.

An embodiment of the utility model provides a portable toy gun capable of being quickly assembled and dismantled.

Figure 1:
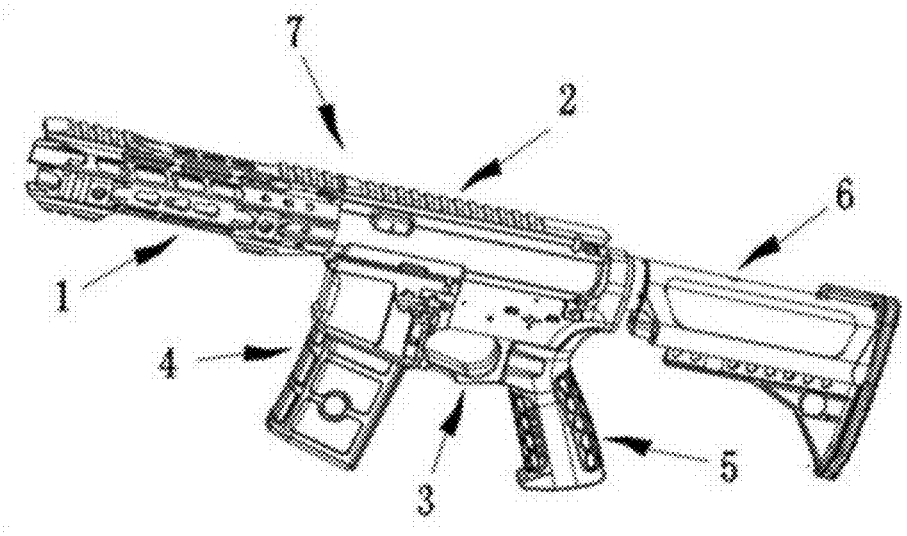
FIG. 1 is a perspective view of a portable toy gun capable of being quickly assembled and dismantled provided by an embodiment of the utility model.
Figure 2:
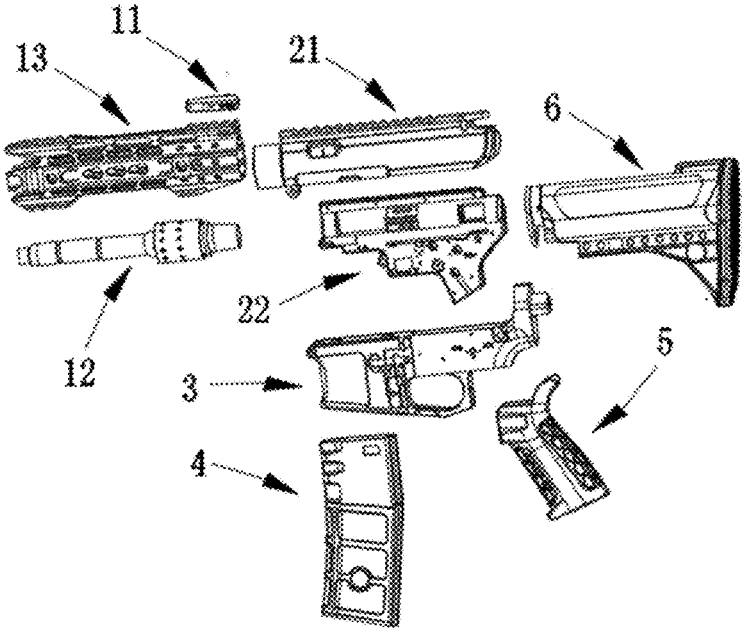
FIG. 2 is an exploded view of FIG. 1.
Figure 3:
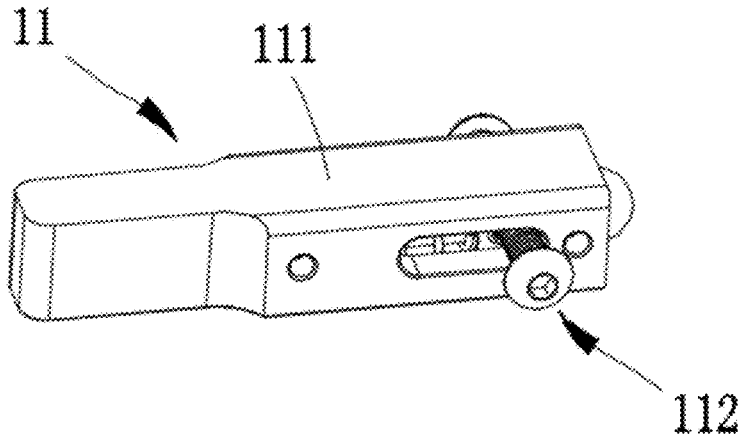
FIG. 3 is a perspective view of a locking mechanism of a portable toy gun capable of being quickly assembled and dismantled provided by an embodiment of the utility model.
Figure 4:
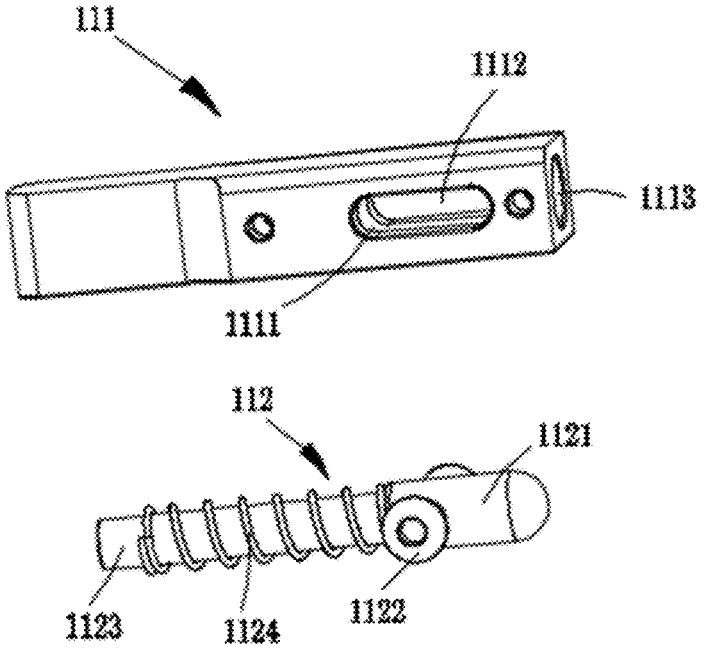
FIG. 4 is an exploded view of FIG. 3.
Figure 5:
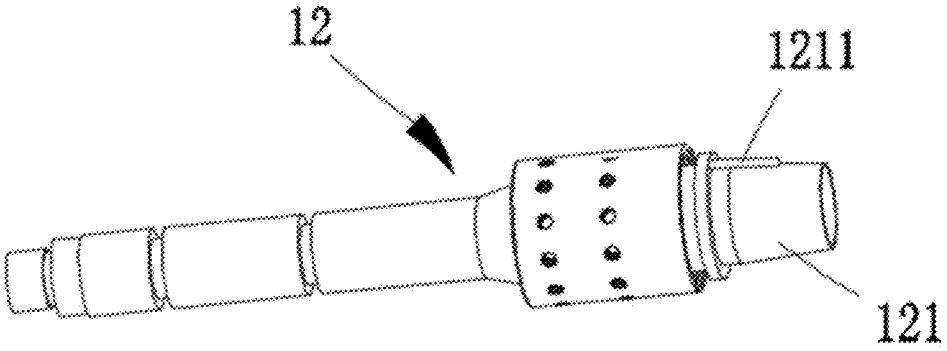
FIG. 5 is a perspective view of a first bore of a portable toy gun capable of being quickly assembled and dismantled provided by an embodiment of the utility model.
Figure 6:
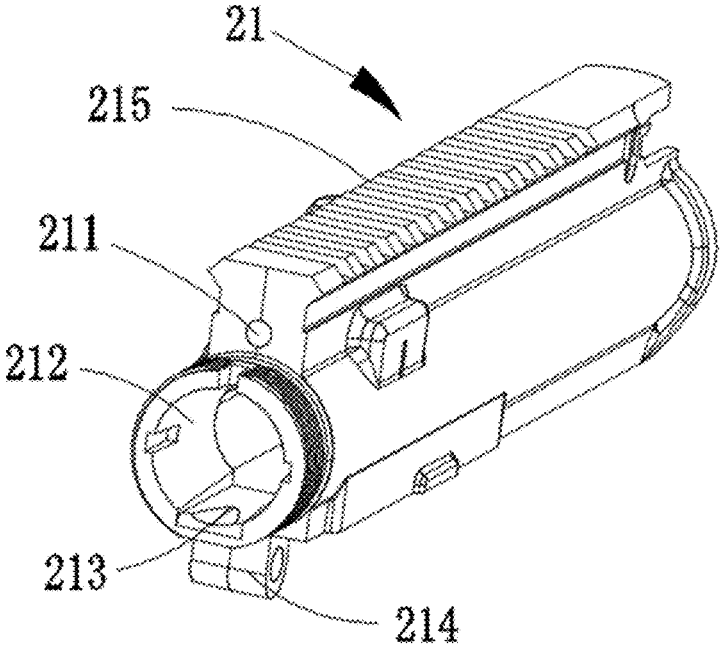
FIG. 6 is a perspective view of a second gun barrel outer sleeve of a portable toy gun capable of being quickly assembled and dismantled provided by an embodiment of the utility model.
Figure 7:
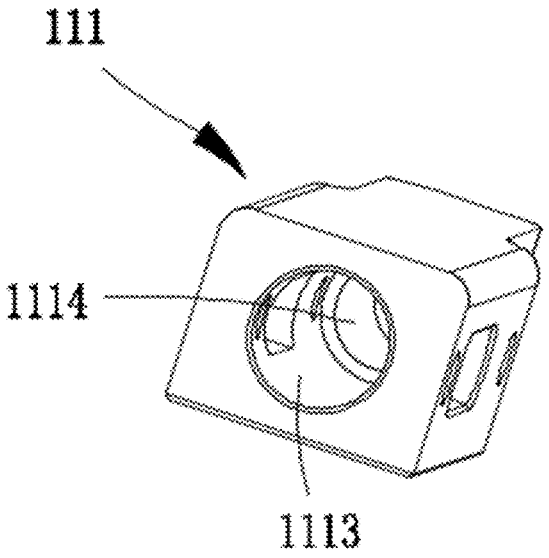
FIG. 7 is a perspective view of a locating sleeve of a portable toy gun capable of being quickly assembled and dismantled provided by an embodiment of the utility model.

Referring to FIG. 1 to FIG. 7, the utility model provides a portable toy gun capable of being quickly assembled and dismantled. The toy gun includes a gun barrel 7. A gun stock 6 is mounted at one end of the gun barrel 7. A trigger component 3 is connected to one side of the gun barrel 7. A handle 5 is mounted at one end of the trigger component 3, and a magazine 4 is mounted at the other end of the trigger component 3. The gun barrel 7 includes a first gun barrel 1, and a second gun barrel 2 detachably connected with the first gun barrel 1. The first gun barrel 1 includes a first gun barrel outer sleeve 13, a first bore 12 mounted in the first gun barrel outer sleeve 13, and a locking mechanism 11 mounted on the outer side of one end of the first gun barrel outer sleeve 13. A plug 121 is mounted at one end of the first bore 12. A guiding locating protrusion 1211 is disposed on one side of the plug 121. The second gun barrel 2 includes a second gun barrel outer sleeve 21, and a second bore 22 mounted in the second gun barrel outer sleeve 21. One end of the second gun barrel outer sleeve 21 defines a locking hole 211 corresponding to the locking mechanism 11, and a slot 212 corresponding to the plug 121. The slot 212 has an inner wall defining a locating groove 213 corresponding to the guiding locating protrusion 1211. The guiding locating protrusion 1211 of the plug 121 can be aligned to and inserted into the locating groove 21, so that the plug 121 is inserted into the slot 212 and the first bore 12 is connected to the second gun barrel outer sleeve 21 in a clamping manner; next, the first gun barrel 1 or the second gun barrel 2 can be rotated so that the locking mechanism on the first gun barrel outer sleeve 13 is aligned to and clamped into the locking hole on the second gun barrel outer sleeve 21. As a result, the connection between the first gun barrel 1 and the second gun barrel 2 is realized.

The second gun barrel outer sleeve 21 has one side corresponding to the locating groove 213 mounted with a locating base 214. By making the locating base 214 aligned to the guiding locating protrusion 1211 on the plug 121, the guiding locating protrusion 1211 can be aligned to and inserted into the locating groove 213 quickly. Thus, the quick clamp connection between the first gun barrel 1 and the second gun barrel 2 is realized.

The locking mechanism 11 includes a locating sleeve 111, and a locating core 112 mounted in the locating sleeve 111. The locating core 112 slides in the locating sleeve 111.

The locating sleeve 111 has one side defining a first limiting hole 1111 and the other side defining a second limiting hole 1112. The locating sleeve 111 defines therein a slide groove 1113, and a locating slide groove 1114 in communication with the slide groove 1113. The locating core 112 includes a limiting rod 1122 passing through the first limiting hole 1111 and the second limiting hole 1112. The limiting rod 1122 is in fixed connection with a locating rod 1121 corresponding to the locking hole 211. The limiting rod 1122 can be toggled to control the connection and disconnection between the locating rod 1121 and the locking hole 211. The locating rod 1121 has one end connected with a sliding rod 1123. The sliding rod 1123 has a spring 1124 sleeved thereon. The spring applies a force to the locating rod 1121, so that the locating rod 1121 cannot slide off from the locking hole 211 easily. The locating rod 1121 is in sliding connection with the locating sleeve 111 in the slide groove 1113. One end of the sliding rod 1123 in connection with the locating rod 1121 is in sliding connection with the locating sleeve 111 in the slide groove 1113, and the other end of the sliding rod 1123 is in sliding connection with the locating sleeve 111 in the locating slide groove 1114.

The spring 1124 has a width greater than that of the locating slide groove 1114 and less than that of the locating rod 1121, so that the spring 1124 can be limited by the locating sleeve 111 and can apply a pressure to the locating rod 1121. Therefore, the locating rod 1121 is pushed into the locking hole 211 and cannot fall off easily.

The width of the locating rod 1121 is less than that of the locking hole 211, so that the locating rod 1121 can be inserted into the locking hole 211 smoothly.

One end of the locating rod 1121 inserted into the locking hole 211 is provided as a circular arc shape, facilitating the locating rod 1121 to be inserted into the locking hole 211.

The guiding locating protrusion 1211 has a width less than that of the locating groove 213, so that the guiding locating protrusion 1211 can be inserted into the locating groove 213.

The first gun barrel outer sleeve 13 and the second gun barrel outer sleeve 21 have a clamping groove 215 defined on one side thereof. The clamping groove 215 is configured for quickly mounting a gun-sight. The gun-sight can be mounted at different positions on the gun barrel 1 as actually needed.

During the assembling of the toy gun, first, the locating base 214 is aligned to the guiding locating protrusion 1211 on the plug 121, and then the plug 121 is inserted into the slot 212, as a result, the guiding locating protrusion 1211 can be aligned to and inserted into the locating groove 213, and the first gun barrel 1 can be in clamp connection with the second gun barrel 2 quickly; next, the limiting rod 1122 is toggled to the other ends of the first limiting hole 1111 and the second limiting hole 1112, so that the locating rod 1121 retracts to the slide groove 1113; next, the first gun barrel 1 or the second gun barrel 2 is rotated so that the slide groove 1113 is aligned to the locking hole 211; then, the limiting rod 1122 is released so that the locating rod 1121 slides out from the slide groove 1113 and is inserted into the locking hole 211 under the force of the spring 1124, at such time the limiting rod 1122 is limited by the first limiting hole 1111 and the second limiting hole 1112. By this time, the assembling of the first gun barrel 1 and the second gun barrel 2 is completed. Since the guiding locating protrusion 1211 is clamped in the locating groove 213 and the spring 1124 applies a pressure to the locating rod 1121, the first gun barrel 1 and the second gun barrel 2 are in firm connection and cannot fall off easily.

During the dismantling of the toy gun, the limiting rod 1122 is toggled to the other ends of the first limiting hole 1111 and the second limiting hole 1112, so that the locating rod 1121 slides out from the locking hole 211; when the locating rod 1121 retracts into the slide groove 1113, the first gun barrel 1 or the second gun barrel 2 is rotated, so that the first gun barrel 1 and the second gun barrel 2 are separated. The dismantling process is simple and quick.

To sum up, the toy gun is simple in structure, can be quickly dismantled and assembled, facilitates outdoor carrying and indoor storage, and is good in connection stability and strong in practicability.

The above embodiments are preferred implementations of the utility model. However, the implementations of the utility model are not limited to the above embodiments. Any other changes, modifications, substitutions, combinations and simplifications made without departing from the spirit and principle of the utility model should be viewed as equivalent replacements and are intended to be included in the scope of protection of the utility model.

What is claimed is:

1. A portable toy gun capable of being quickly assembled and dismantled, comprising a gun barrel (7), a gun stock (6) being mounted at one end of the gun barrel (7), a trigger component (3) being connected to one side of the gun barrel (7), a handle (5) being mounted at one end of the trigger component (3) and a magazine (4) being mounted at the other end of the trigger component (3), wherein the gun barrel (7) comprises a first gun barrel (1) and a second gun barrel (2) detachably connected with the first gun barrel (1), the first gun barrel (1) comprises a first gun barrel outer sleeve (13), a first bore (12) mounted in the first gun barrel outer sleeve (13), and a locking mechanism (11) mounted on the outer side of one end of the first gun barrel outer sleeve (13), a plug (121) is mounted at one end of the first bore (12), a guiding locating protrusion (1211) is disposed on one side of the plug (121), the second gun barrel (2) comprises a second gun barrel outer sleeve (21) and a second bore (22) mounted in the second gun barrel outer sleeve (21), one end of the second gun barrel outer sleeve (21) defines a locking hole (211) corresponding to the locking mechanism (11) and a slot (212) corresponding to the plug (121), and the slot (212) has an inner wall defining a locating groove (213) corresponding to the guiding locating protrusion (1211).

2. The portable toy gun capable of being quickly assembled and dismantled according to claim 1, wherein the second gun barrel outer sleeve (21) has one side corresponding to the locating groove (213) mounted with a locating base (214).

3. The portable toy gun capable of being quickly assembled and dismantled according to claim 1, wherein the locking mechanism (11) comprises a locating sleeve (111), and a locating core (112) mounted in the locating sleeve (111).

4. The portable toy gun capable of being quickly assembled and dismantled according to claim 3, wherein the locating sleeve (111) has one side defining a first limiting hole (1111) and the other side defining a second limiting hole (1112), the locating sleeve (111) defines therein a slide groove (1113) and a locating slide groove (1114) in communication with the slide groove (1113), the locating core (112) comprises a limiting rod (1122) passing through the first limiting hole (1111) and the second limiting hole (1112), the limiting rod (1122) is in fixed connection with a locating rod (1121) corresponding to the locking hole (211), the locating rod (1121) has one end connected with a sliding rod (1123), the sliding rod (1123) has a spring (1124) sleeved thereon, the locating rod (1121) is in sliding connection with the locating sleeve (111) in the slide groove (1113), one end of the sliding rod (1123) in connection with the locating rod (1121) is in sliding connection with the locating sleeve (111) in the slide groove (1113), the other end of the sliding rod (1123) is in sliding connection with the locating sleeve (111) in the locating slide groove (1114).

5. The portable toy gun capable of being quickly assembled and dismantled according to claim 4, wherein the spring (1124) has a width greater than that of the locating slide groove (1114) and less than that of the locating rod (1121).

6. The portable toy gun capable of being quickly assembled and dismantled according to claim 5, wherein the width of the locating rod (1121) is less than that of the locking hole (211).

7. The portable toy gun capable of being quickly assembled and dismantled according to claim 1, wherein the first gun barrel outer sleeve (13) and the second gun barrel outer sleeve (21) have a clamping groove (215) defined on one side thereof.

* * * * *